US010610881B2

(12) United States Patent
Choi et al.

(10) Patent No.: US 10,610,881 B2
(45) Date of Patent: Apr. 7, 2020

(54) SLOT DIE COATING APPARATUS

(71) Applicant: SUNG AN MACHINERY CO., LTD., Hwaseong-si, Gyeonggi-do (KR)

(72) Inventors: Dong Kwon Choi, Gunpo-si (KR); Ok Jin Kim, Hwaseong-si (KR); Dong Hoon Kim, Seoul (KR); Jang Hwan Lee, Seoul (KR); Young Min Lee, Gunpo-si (KR); Young Jin Kim, Suwon-si (KR); Tae Su Chun, Gwangju (KR)

(73) Assignee: SUNG AN MACHINERY CO., LTD., Hwaseong-si (KR)

( * ) Notice: Subject to any disclaimer, the term of this patent is extended or adjusted under 35 U.S.C. 154(b) by 200 days.

(21) Appl. No.: 15/561,465

(22) PCT Filed: Apr. 15, 2016

(86) PCT No.: PCT/KR2016/003912

§ 371 (c)(1),
(2) Date: Sep. 25, 2017

(87) PCT Pub. No.: WO2016/167585

PCT Pub. Date: Oct. 20, 2016

(65) Prior Publication Data

US 2018/0117619 A1 May 3, 2018

(30) Foreign Application Priority Data

Apr. 17, 2015 (KR) ..... 10-2015-0054643

(51) Int. Cl.
*B05C 5/02* (2006.01)
*B05C 11/10* (2006.01)

(52) U.S. Cl.
CPC ..... *B05C 5/0225* (2013.01); *B05C 5/0254* (2013.01); *B05C 11/10* (2013.01);
(Continued)

(58) Field of Classification Search
None
See application file for complete search history.

(56) References Cited

U.S. PATENT DOCUMENTS 6,475,282 B1 * 11/2002 Snodgrass ..... B05C 5/004 118/410
2002/0121239 A1 * 9/2002 Tonazzi ..... B05C 5/0254 118/401

(Continued)

FOREIGN PATENT DOCUMENTS

JP 11309400 A * 11/1999
JP 2002-159885 A 6/2002

(Continued)

OTHER PUBLICATIONS

English translation of KR-20130011237-A (Year: 2013).*

(Continued)

*Primary Examiner* — Charles Capozzi
(74) *Attorney, Agent, or Firm* — Novick, Kim & Lee, PLLC; Sang Ho Lee

(57) ABSTRACT

The present invention relates to a slot die coating apparatus. A slot die coating apparatus according to an embodiment of the present invention includes: a slot die configured to perform a coating process by applying ink to a substrate; an image capturing unit disposed adjacent to the slot die and configured to capture a state of the slot die and a state of ink applied to the substrate during the coating process; and a control unit configured to compare an image captured by the image capturing unit with a reference image and control an operation of the slot die and a transfer of the substrate.

5 Claims, 10 Drawing Sheets

(52) U.S. Cl.
CPC ..... *B05C 11/1005* (2013.01); *B05C 11/1007* (2013.01); *B05C 5/022* (2013.01); *B05C 5/0258* (2013.01)

(56) References Cited

U.S. PATENT DOCUMENTS

| | | | | |
|---|---|---|---|---|
| 2012/0000420 | A1* | 1/2012 | Ikagawa | B05C 5/0258 118/708 |
| 2013/0025535 | A1* | 1/2013 | Choi | B05C 5/0254 118/302 |
| 2016/0030970 | A1* | 2/2016 | Okamura | H05K 1/0269 118/713 |

FOREIGN PATENT DOCUMENTS

| | | | |
|---|---|---|---|
| JP | 2003-247949 | A | 9/2003 |
| KR | 10-2012-0004441 | A | 1/2012 |
| KR | 10-2013-0011237 | A | 1/2013 |
| KR | 10-2013-0113621 | A | 10/2013 |

OTHER PUBLICATIONS

English translation of JP-11309400-A (Year: 1999).*
English translation of JP2003247949.*
English translation of KR20130113621.*

* cited by examiner

SLOT DIE COATING APPARATUS

TECHNICAL FIELD

The present invention relates to a slot die coating apparatus, and more particularly, to a slot die coating apparatus which is capable of monitoring a state of a slot die and a state of ink applied to a substrate in real time and is capable of uniformly and thinly applying ink to the substrate.

BACKGROUND ART

Recently, printed electronics technology for manufacturing electronic devices by a method of forming various patterns by printing functional ink (hereinafter, collectively referred to as ink) on various types of substrates has attracted attention.

Such printed electronics technology has an advantage that the manufacturing process is not complicated, as compared with photolithography technology that has been used for forming patterns on a substrate. Further, a roll-to-roll printing apparatus that prints functional ink on a roll-shaped film or web (hereinafter, collectively referred to as a film) continuously supplied further increases production efficiency of electronic devices by a rapid production speed due to a continuous process.

In general, the roll-to-roll printing apparatus performs a coating process of applying ink so as to perform a printing process on a film. Such a coating process may be performed by a gravure method, a rotary screen method, a slot die method, or the like. Among them, the coating method using a slot die has advantages in that coating can be performed over a wide width all at once, there is no change in ink viscosity, no foreign matter is introduced, and the reproducibility of ink coating is excellent.

Meanwhile, printing accuracy is very important so as to manufacture an electronic device by using a printed electronics technology that prints ink on a substrate. In general, an electronic device requires a printing accuracy of several to several tens of microns (μm).

In general, a slot die coating apparatus, which performs a slot die coating process, requires ink to be thinly and uniformly applied to a substrate so as to improve the printing accuracy of an electronic device. To this end, it is important to quantitatively adjust ink supplied to a slot die according to a coating process condition and to coat a thin ink film to a desired thickness by adjusting a gap between the slot die and the substrate.

However, the conventional slot die coating apparatus adjusts a supply amount of ink in a state in which the coating process is temporarily stopped through the state of the substrate on which the coating process is performed, or adjusts a gap between the slot die and the substrate. Due to this, the conventional slot die coating apparatus cannot cope with various changes in the process condition during the coating process on the substrate, and thus, the coating uniformity of ink cannot be maintained.

In particular, in the case of a slot die coating apparatus used in a conventional roll-to-roll printing apparatus, when a film is deformed during a coating process due to external conditions such as heat or humidity and thus a register error occurs, a transfer speed and a tension of the film change for register control. Consequently, it has been difficult to thinly and uniformly apply ink to the substrate.

Therefore, there is a need for a slot die coating apparatus which is capable of monitoring a state of a slot die and a state of ink applied to a substrate in real time and is capable of thinly and uniformly applying ink to the substrate.

SUMMARY OF INVENTION

Technical Problem

The present invention has been made in an effort to solve the above problems, and an object of the present invention is to provide a slot die coating apparatus which is capable of monitoring a state of a slot die and a state of ink applied to a substrate in real time and thinly and is capable of uniformly applying ink to the substrate by controlling the operation of the slot die and the transfer of the substrate by capturing the state of the slot die and the state of the ink applied to the substrate by using an image capturing unit while a coating process using the slot die is performed.

The technical objects of the present invention are not limited to the above-mentioned object, and other technical objects will be clearly understood from the following description by those skilled in the art.

Solution to Problem

In order to achieve the above objects, a slot die coating apparatus according to an embodiment of the present invention includes: a slot die configured to perform a coating process by applying ink to a substrate; an image capturing unit disposed adjacent to the slot die and configured to capture a state of the slot die and a state of ink applied to the substrate during the coating process; and a control unit configured to compare an image captured by the image capturing unit with a reference image and control an operation of the slot die and a transfer of the substrate.

The image capturing unit includes: at least one first camera disposed at at least one end of both ends of the slot die and configured to capture a meniscus of ink discharged from the slot die; and at least one second camera disposed at at least one of a front end and a rear end of the slot die and configured to capture a shape of coating bead between the slot die and the substrate, and the control unit compares the meniscus of the ink captured by the at least one first camera with a first reference image, compare the shape of the coating bead between the slot die and the substrate captured by the at least one second camera with a second reference image, and controls the operation of the slot die and the transfer of the substrate.

The image capturing unit further includes a capturing driving unit configured to drive the at least one second camera to reciprocate along a length direction of the slot die.

The slot die includes: a first body having a length corresponding to a width of the substrate and defining a space in which the ink supplied from the outside is accommodated; a second body having a length corresponding to the first body and forming a discharge port, through which the ink is discharged, when coupled to the first body; and at least one diffuser disposed adjacent to the discharge port and configured to diffuse the ink discharged through the discharge port.

The slot die further includes a shim plate disposed between the first body and the second body and having a plurality of slits opened in a downward direction at positions adjacent to the discharge port.

The slot die coating apparatus according to an embodiment of the present invention further includes a slot die driving unit connected to the slot die and configured to move the position of the slot die by driving the slot die according to a result of the comparison between the image captured by the image capturing unit and the reference image.

The slot die coating apparatus according to an embodiment of the present invention further includes a pattern capturing unit disposed adjacent to the slot die and configured to capture at least one coating pattern provided in the substrate during the coating process, wherein the control unit compares the coating pattern captured by the pattern capturing unit with a reference pattern and controls the operation of the slot die and the transfer of the substrate.

The pattern capturing unit includes: at least one third camera disposed at a front end of the slot die along a transfer direction of the substrate and configured to capture a first coating pattern provided in the substrate before the coating process; and at least one fourth camera disposed at a rear end of the slot die along a transfer direction of the substrate and configured to capture the first coating pattern and a second coating pattern provided in the substrate after the coating process, wherein the control unit compares the first coating pattern captured by the at least one third camera with a first reference image, compare the first coating pattern with the second coating pattern captured by the at least one fourth camera, and controls the operation of the slot die and the transfer of the substrate.

Specific matters of the embodiments are included in the detailed description and the drawings.

Advantageous Effects of Invention

The slot die coating apparatus according to an embodiment of the present invention can monitor the state of the slot die and the state of ink applied to the substrate in real time and thinly and uniformly apply ink to the substrate by controlling the operation of the slot die and the transfer of the substrate by capturing the state of the slot die and the state of the ink applied to the substrate by using the image capturing unit while the coating process using the slot die is performed.

In addition, since the image capturing unit is configured by the first camera that captures the meniscus of the ink discharged from the slot die and the second camera that captures the shape of the coating bead between the slot die and the substrate, the slot die coating apparatus according to an embodiment of the present invention can monitor the state of the slot die and the state of the ink applied to the substrate in real time during the coating process.

Furthermore, since the diffuser for diffusing the ink is provided in the discharge port of the slot die, the slot die coating apparatus according to an embodiment of the present invention can further improve the coating uniformity of the ink with respect to the substrate.

Moreover, since the operation of the slot die and the transfer of the substrate are controlled in real time by capturing the coating pattern provided in the substrate by using the pattern capturing unit while the coating process using the slot die is performed, the slot die coating apparatus according to an embodiment of the present invention can control the register with respect to the film-type substrate, thereby improving the quality of products produced through the coating process.

The effects of the present invention are not limited to the effects mentioned above, and other effects can be clearly understood from the description of the claims by those skilled in the art.

DESCRIPTION OF EMBODIMENTS

Figure 1:
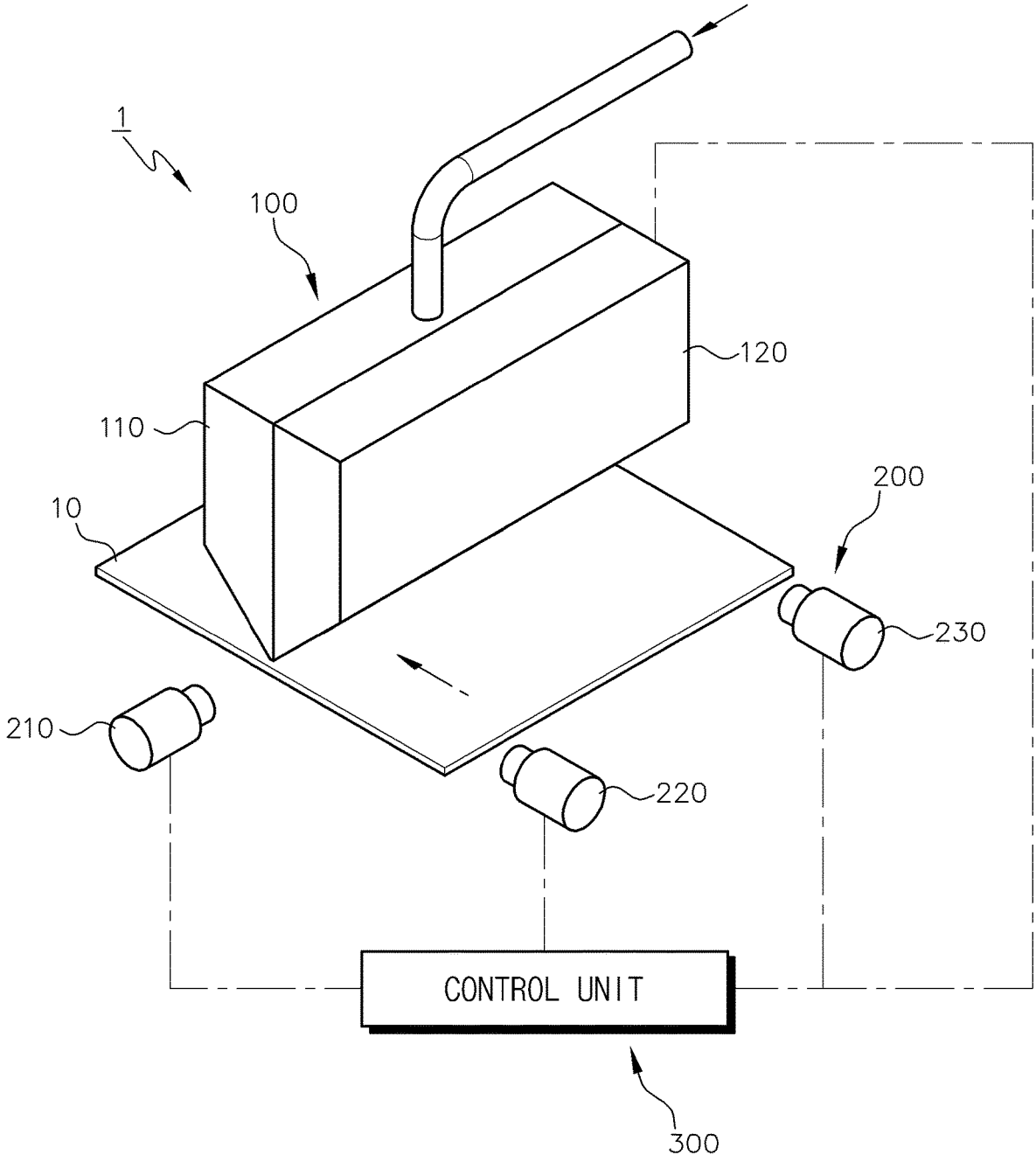
FIG. 1 is a perspective view schematically illustrating a configuration of a slot die coating apparatus according to an embodiment of the present invention.

Hereinafter, preferred embodiments of the present invention will be described in detail with reference to the accompanying drawings in such a manner that the present invention can be easily carried out by those skilled in the art to which the present invention pertains.

Detailed description of well-known functions and structures incorporated herein may be omitted to avoid obscuring the subject matter of the present invention. This aims to omit unnecessary description so as to make the subject matter of the present invention clearer.

For the same reason, some of elements are exaggerated, omitted, or simplified in the drawings, and in practice, the elements may have sizes and/or shapes different from those shown in drawings. The same reference numbers are used to refer to the same or like parts throughout the specification and the drawings.

Hereinafter, a slot die coating apparatus 1 according to embodiments of the present invention will be described in detail with reference to the accompanying drawings.

FIG. 1 is a perspective view schematically illustrating a configuration of a slot die coating apparatus according to an embodiment of the present invention.

As illustrated in FIG. 1, the slot die coating apparatus 1 according to an embodiment of the present invention may include a slot die 100, an image capturing unit 200, and a control unit 300.

The slot die 100 may perform a coating process by applying ink to a substrate 10. As described above, the coating process using the slot die 100 has advantages in that coating can be performed on the substrate 10 having a wide width all at once, there is no change in ink viscosity and no introduction of foreign matter because ink is not exposed to air in the process of supplying ink from an ink storage tank (not illustrated) to the slot die 100, and stability and reproducibility of ink coating is excellent.

As illustrated in FIG. 1, the slot die 100 may form an ink accommodation space (111 of FIG. 2) which is defined by coupling a first body 110 and a second body 120, and a discharge port (112 of FIG. 2) through which ink is discharged to the substrate 10. A detailed structure of the slot die 100 will be described in detail with reference to FIGS. 2 and 3.

The image capturing unit 200 may be disposed adjacent to the slot die 100 and may capture a state of the slot die 100 and a state of ink applied to the substrate 10 during the coating process. The image capturing unit 200 may use a complementary metal-oxide semiconductor (CMOS) camera, a charge-coupled device (CCD) camera, or the like. As illustrated in FIG. 1, the image capturing unit 200 may include a plurality of cameras 210, 220, and 230 at positions adjacent to the slot die 100. Each of the cameras 210, 220, and 230 may capture a state of the slot die 100 and a state of ink discharged from the slot die 100 and applied to the substrate 10 by capturing a gap between the slot die 100 and the substrate 10 at a predetermined position. A detailed structure of the image capturing unit 200 will be described in detail with reference to FIGS. 4 and 5.

Referring to FIG. 1 again, the control unit 300 may be connected to the slot die 100 and the image capturing unit 200 and may compare an image captured by the image capturing unit 200 with a reference image and control the operation of the slot die 100 and the transfer of the substrate 10. That is, the control unit 300 may receive a captured actual image from the image capturing unit 200 during the coating process, compare the received captured actual image with the preset reference image, determine a state of the slot die 100 and a state of ink applied to the substrate 10, and control the operation of the slot die 100 and the transfer of the substrate 10 so that the actual image is matched with the reference image.

For example, the control unit 300 may adjust a flow rate of ink supplied to the slot die 100 or may adjust a position of the slot die 100, so as to adjust a state of ink discharged from the slot die 100 and applied to the substrate 10. Alternatively, the control unit 300 may adjust a transfer speed of the substrate 10 so as to adjust a state of ink discharged from the slot die 100 and applied to the substrate 10. Although not illustrated, a substrate transfer unit (not illustrated) for transferring the substrate 10 may be provided at a position adjacent to the slot die coating apparatus 1 (below the slot die coating apparatus 1 in the example of FIG. 1), and the control unit 300 may be connected to the substrate transfer unit to adjust the transfer speed of the substrate 10.

Hereinafter, the structure of the slot die 100 provided in the slot die coating apparatus 1 according to an embodiment of the present invention will be described in detail with reference to FIGS. 2 and 3.

Figure 2:
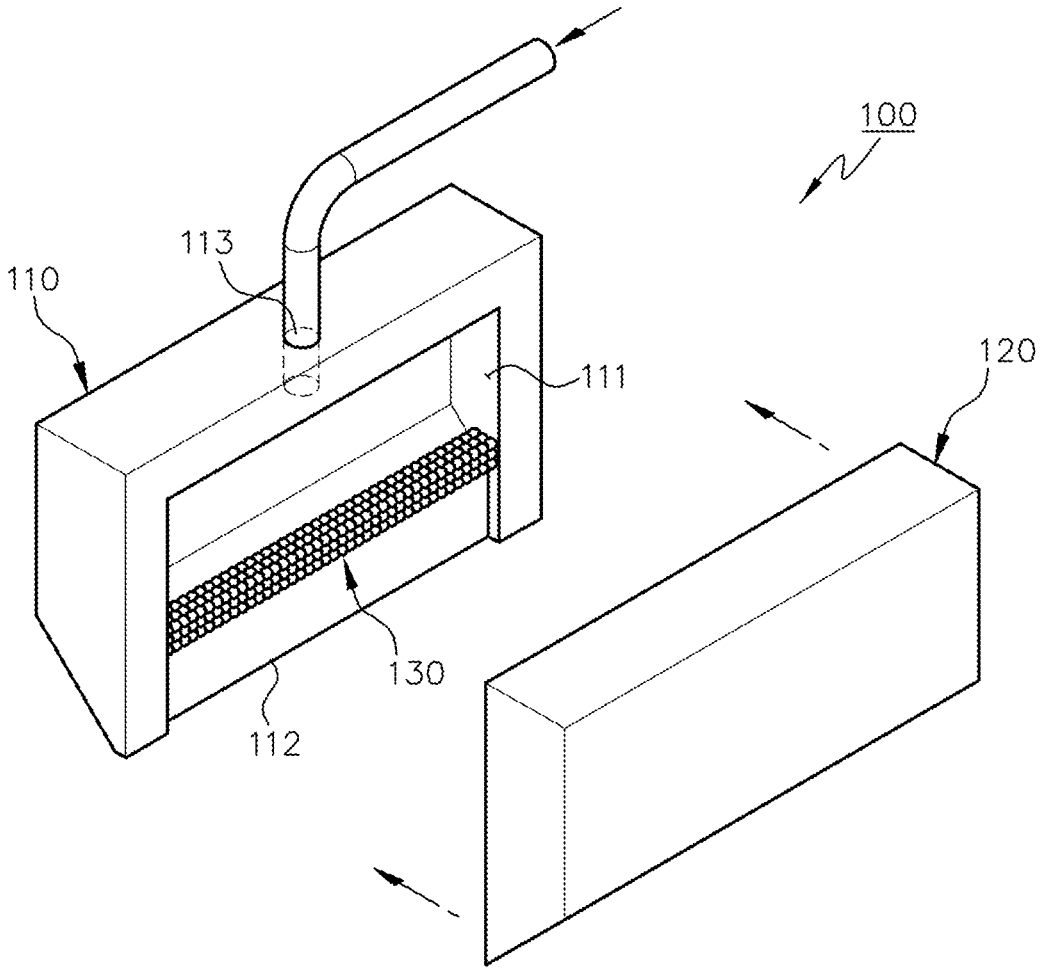
FIG. 2 is an exploded perspective view schematically illustrating an example of a slot die constituting a slot die coating apparatus according to an embodiment of the present invention.

FIG. 2 is an exploded perspective view schematically illustrating an example of the slot die constituting the slot die coating apparatus according to an embodiment of the present invention.

FIG. 2 illustrates an example of a structure in which the slot die 100 includes a first body 110, a second body 120, and at least one diffuser 130.

As illustrated in FIG. 2, the first body 110 and the second body 120 may be formed so long as to have a length corresponding to a width of the substrate 10 and formed to have a cross-section that becomes narrower in a downward direction. In addition, a cavity 111 in which ink supplied from the outside is accommodated may be formed in the first body 110. When the first body 110 and the second body 120 are coupled to each other, a discharge port 112 through which ink is discharged in a downward direction may be formed. Although FIG. 2 illustrates an example in which the discharge port 112 is formed only in the first body 110, the present invention is not limited thereto. The shape and the formation position of the discharge port 112 may be variously modified by those skilled in the art.

The at least one diffuser 130 may be disposed at a position adjacent to the discharge port 112 and may diffuse ink discharged through the discharge port 112. As such, since the diffuser 130 which assists in diffusing the ink is provided in the slot die 100, it is possible to uniformly apply the ink discharged from the discharge port 112 of the slot die 100 to the substrate 10.

As illustrated in FIG. 2, the diffuser 130 may use a plurality of spherical bodies regularly arranged at the discharge port 112 of the slot die 100. This is because the ink can be easily diffused and flowed into gaps between the plurality of spherical bodies regularly arranged. In addition, each of the spherical bodies constituting the diffuser 130 may be made of a ceramic material. This is because the spherical body made of the ceramic material is not corroded by the ink due to its excellent corrosion resistance. Although FIG. 2 illustrates an example in which the diffuser 130 includes the plurality of spherical bodies made of the ceramic material, the present invention is not limited thereto. The diffuser 130 may be variously modified by those skilled in the art.

Meanwhile, as illustrated in FIG. 2, a supply hole 113 may be formed at an upper end of the first body 110, and the supply hole 113 is connected to a pipe to which the ink is supplied from the ink storage tank (not illustrated) provided at the outside.

Figure 3:
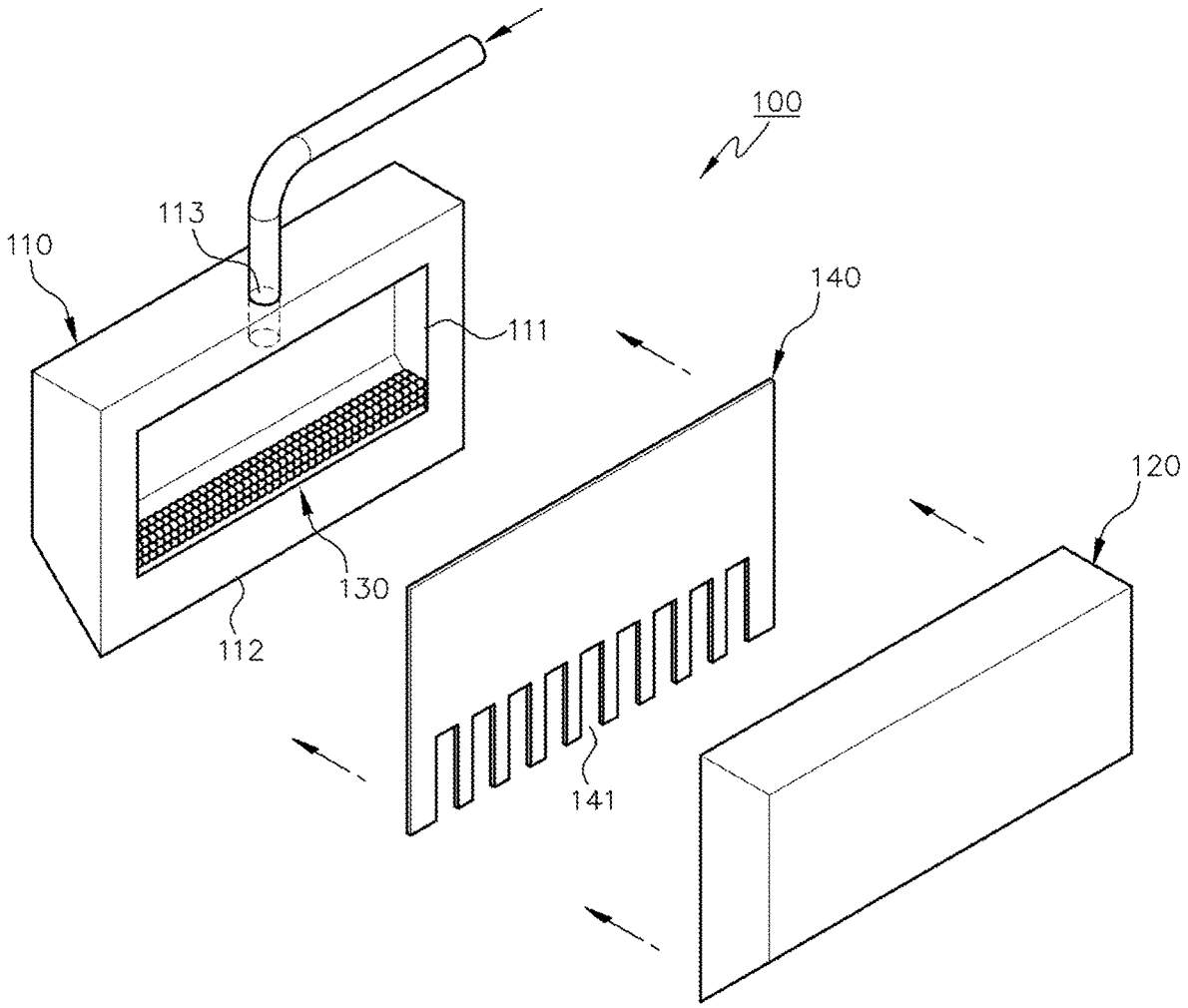
FIG. 3 is an exploded perspective view schematically illustrating another example of a slot die constituting a slot die coating apparatus according to an embodiment of the present invention.

FIG. 3 is an exploded perspective view schematically illustrating another example of the slot die constituting the slot die coating apparatus according to an embodiment of the present invention.

FIG. 3 illustrates an example of a structure in which a shim plate 140 is further included in the structure of the slot die 100 illustrated in FIG. 2.

The shim plate 140 may be disposed between the first body 110 and the second body 120, and a plurality of slits 141 opened in a downward direction may be formed at positions adjacent to the discharge port 112. As illustrated in FIG. 3, the shim plate 140 may have a thin plate shape formed to have substantially the same as the coupled surface of the first body 110 and the second body 120, and the plurality of slits 141 may be formed in a downward direction at regular intervals. Upper ends of the plurality of slits 141 formed in the shim plate 140 may communicate with the ink accommodation space (cavity) 111 formed in the first body 110, and lower ends thereof may communicate with the discharge port 112 formed in the first body 110.

Meanwhile, the image capturing unit 200 of the slot die coating apparatus 1 according to an embodiment of the present invention may include at least one first camera 210 disposed at at least one end of both ends of the slot die 100, and at least one second camera 220 and 230 disposed at at least one of a front end and a rear end of the slot die 100 along the transfer direction of the substrate 10.

That is, the first camera 210 may be disposed at all or part of both ends along a length direction of the slot die 100 formed to be long and may capture a meniscus of ink discharged from the slot die 100, and the second cameras 220 and 230 may be disposed at all or part of both sides along a width direction of the slot die 100 and may capture a a shape of coating bead between the slot die 100 and the substrate 10. The first camera 210 and the second cameras 220 and 230 may be provided in plurality if necessary.

The control unit 300 may compare the meniscus of ink captured by the at least one first camera 210 with a first reference image, compare the shape of the coating bead between the slot die 100 and the substrate 10 captured by the at least one second camera 220 and 230 with a second reference image, and control the operation of the slot die 100 and the transfer of the substrate 10.

Hereinafter, the structure and the operation of the image capturing unit 200 provided in the slot die coating apparatus 1 according to an embodiment of the present invention will be described in detail with reference to FIGS. 4 and 5.

Figure 4:
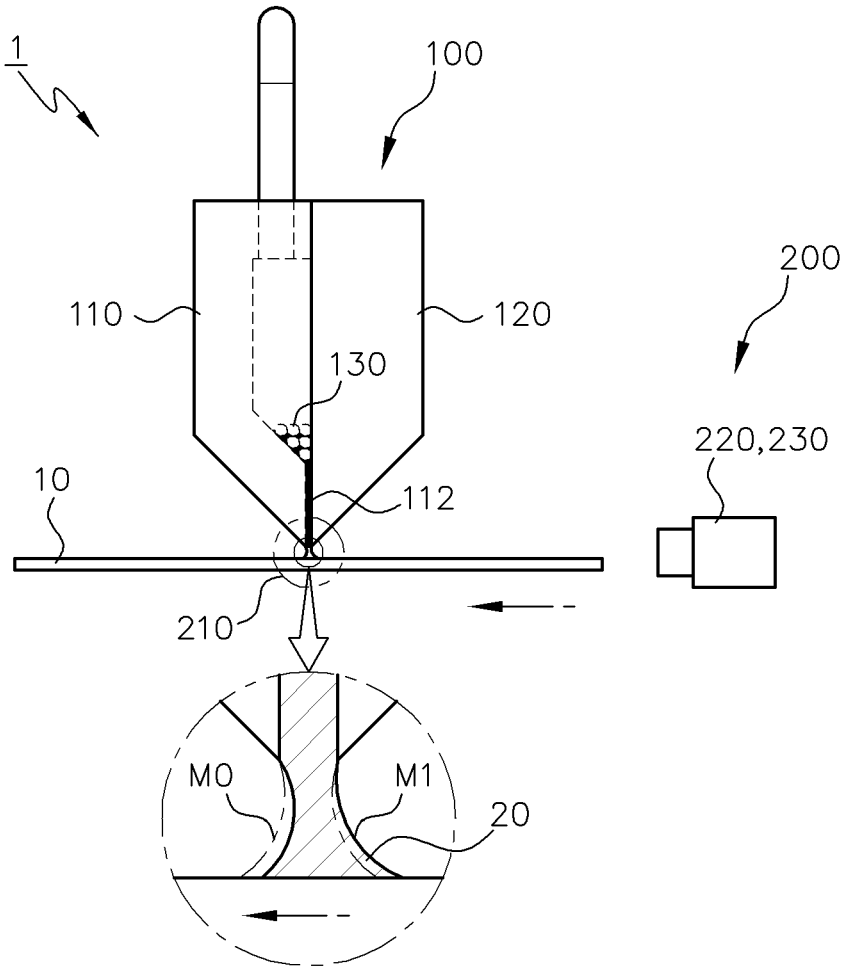
FIG. 4 is a front view schematically illustrating an example of an image capturing unit constituting a slot die coating apparatus according to an embodiment of the present invention.
Figure 5:
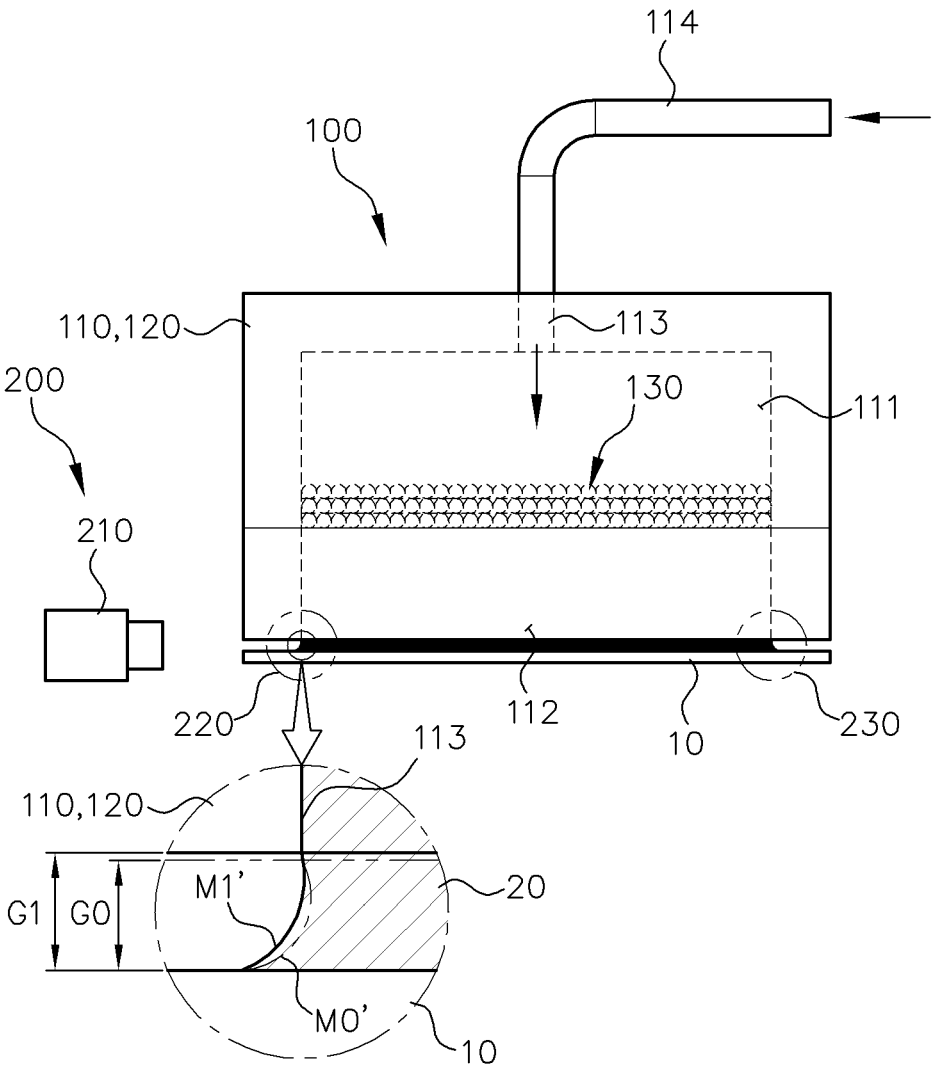
FIG. 5 is a side view schematically illustrating an example of an image capturing unit constituting a slot die coating apparatus according to an embodiment of the present invention.

FIG. 4 is a front view schematically illustrating an example of the image capturing unit constituting the slot die coating apparatus according to an embodiment of the present invention, and FIG. 5 is a side view schematically illustrating an example of the image capturing unit constituting the slot die coating apparatus according to an embodiment of the present invention.

FIGS. 1, 4, and 5 illustrate an example in which one first camera 210 is disposed at only one end of both ends of the slot die 100, and two second cameras 220 and 230 are disposed at the front end of the slot die 100 along the transfer direction of the substrate 10.

As illustrated in FIG. 4, the first camera 210 may be disposed such that a capturing direction thereof faces the discharge port 112 along the length direction of the slot die 100, and may capture, in real time, the meniscus M1 of the ink 20 discharged from the slot die 100 and applied to the substrate 10 during the coating process.

The control unit 300 may compare the actually captured meniscus M1 of the ink 20 with a first reference image M0 preset with respect to a normal condition, determine a state of the slot die 100 and a state of the ink 20 applied to the substrate 10, and adjust a flow rate of the ink 20 supplied to the slot die 100 and a transfer speed of the substrate so that the actually captured meniscus M1 of the ink 20 is matched with the first reference image M0.

In addition, as illustrated in FIG. 5, the second cameras 220 and 230 may be disposed such that a capturing direction thereof faces the discharge port 112 along the width direction of the slot die 100. Two second cameras 220 and 230 may be disposed on both sides of the discharge port 112 elongated along the length direction of the slot die 100. The second cameras 220 and 230 may capture the shape of the coating bead between the slot die 100 and the substrate 10 in real time during the coating process. For example, as illustrated in FIG. 5, the second cameras 220 and 230 may capture the gap between the slot die 100 and the substrate 10 and the meniscus of the ink 20 discharged from the slot die 100 in real time during the coating process.

The control unit 300 may compare the actually captured shape of the coating bead between the slot die 100 and the substrate 10 with a second reference image preset with respect to a normal condition, determine a state of the slot die 100 and a state of the ink 20 applied to the substrate 10, and control the operation of the slot die 100 and the transfer of the substrate 10 so that the actually captured shape of the coating bead between the slot die 100 and the substrate 10 is matched with the second reference image. For example, as illustrated in FIG. 5, the control unit 300 may adjust the height of the slot die 100 so that an actually captured gap G1 between the slot die 100 and the substrate 10 is matched with a gap G0 in the normal condition. Alternatively, as illustrated in FIG. 5, the control unit 300 may adjust a flow rate of the ink 20 supplied to the slot die 100 or a transfer speed of the substrate 10 so that an actually captured side edge M1' of coating bead of the ink 20 is matched with a side edge M0' of coating bead in the normal condition.

Meanwhile, FIGS. 1, 4, and 5 illustrate an example in which one first camera 210 is provided at one end of the slot die 100, and two second cameras 220 and 230 are provided at both ends of the slot die 100, but the number and the arrangement form of the first camera 210 and the second cameras 220 and 230 may be variously modified by those skilled in the art.

Meanwhile, the image capturing unit 200 of the slot die coating apparatus 1 according to an embodiment may further include a capturing driving unit 240 that drives at least one second camera 220 to reciprocate along the length direction of the slot die 100.

Figure 6:
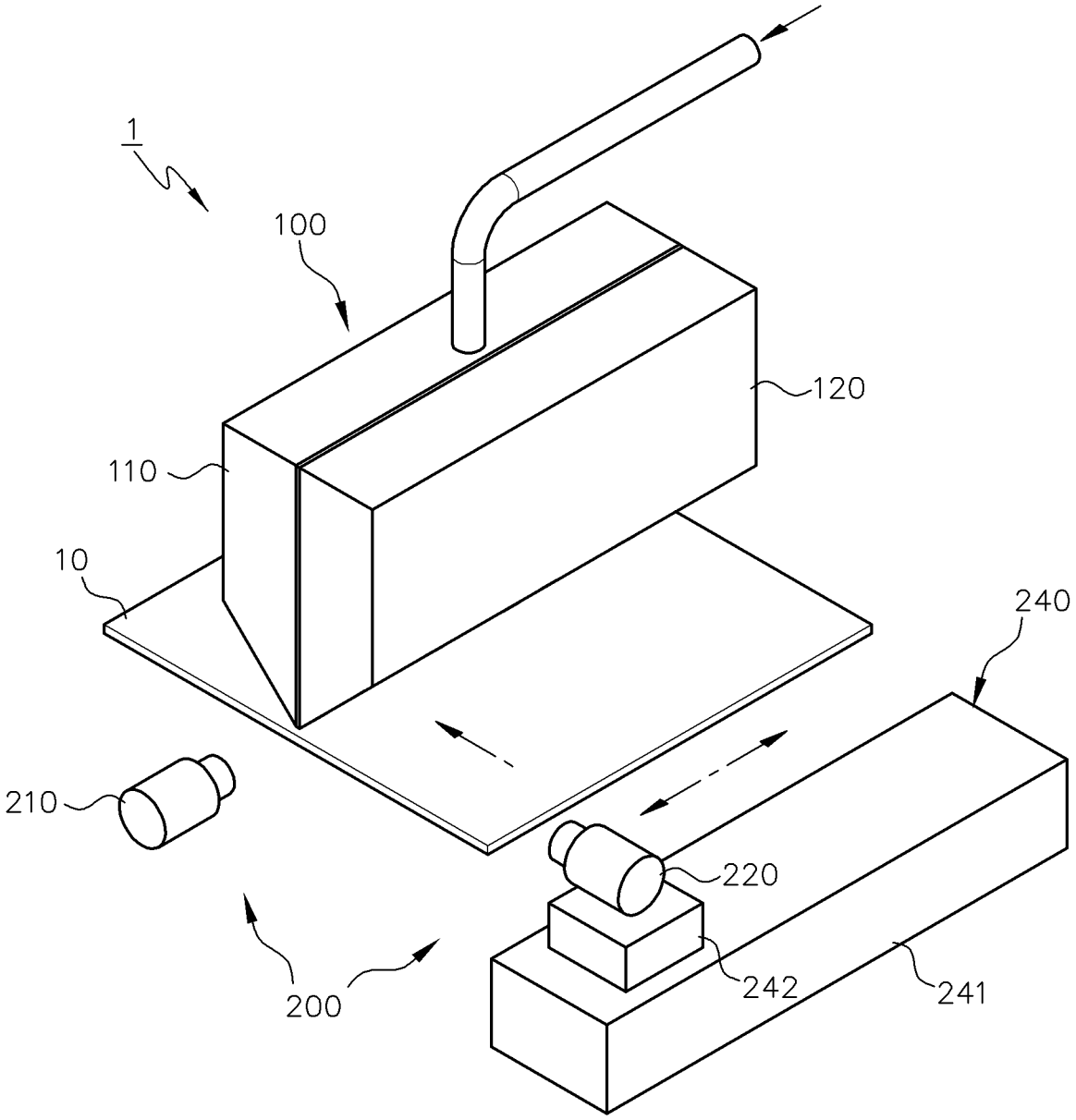
FIG. 6 is a perspective view schematically illustrating another example of an image capturing unit constituting a slot die coating apparatus according to an embodiment of the present invention.

FIG. 6 is a perspective view schematically illustrating another example of the image capturing unit constituting the slot die coating apparatus according to an embodiment of the present invention.

Unlike the image capturing unit 200 illustrated in FIGS. 1, 4, and 5, the image capturing unit 200 illustrated in FIG. 6 may include one second camera 220 and a capturing driving unit 240 that drives the second camera 220 to reciprocate along the length direction of the slot die 100.

That is, the two second cameras 220 provided in the image capturing unit 200 illustrated in FIGS. 1, 4, and 5 are fixed to both sides of the slot die 100 to capture a gap between both sides of the slot die 100 and the substrate 10, but the image capturing unit 200 illustrated in FIG. 6 may capture a shape of coating bead between the slot die 100 and the substrate 10 with respect to the entire slot die 100 while one second camera 220 reciprocates between both sides of the slot die 100 by the capturing driving unit 240 during the coating process.

Although not illustrated in detail, the capturing driving unit 240 may include a driving actuator 241 that generates a straight or rotating driving force, and a fixing block 242 that fixes the second camera 220, is connected to the driving actuator 241, is driven by the driving actuator 241, and reciprocates between both sides of the slot die 100. Preferably, the driving actuator 241 may be implemented by using a linear motion system that converts a rotating driving force generated by a driving motor (not illustrated) into a straight driving force by a ball screw (not illustrated).

Meanwhile, the slot die coating apparatus 1 according to an embodiment of the present invention may further include a slot die driving unit 400 that is connected to the slot die 100 and moves the position of the slot die 100 by driving the slot die 100 according to the result of comparison between the image captured by the image capturing unit 200 and the reference image.

Figure 7:
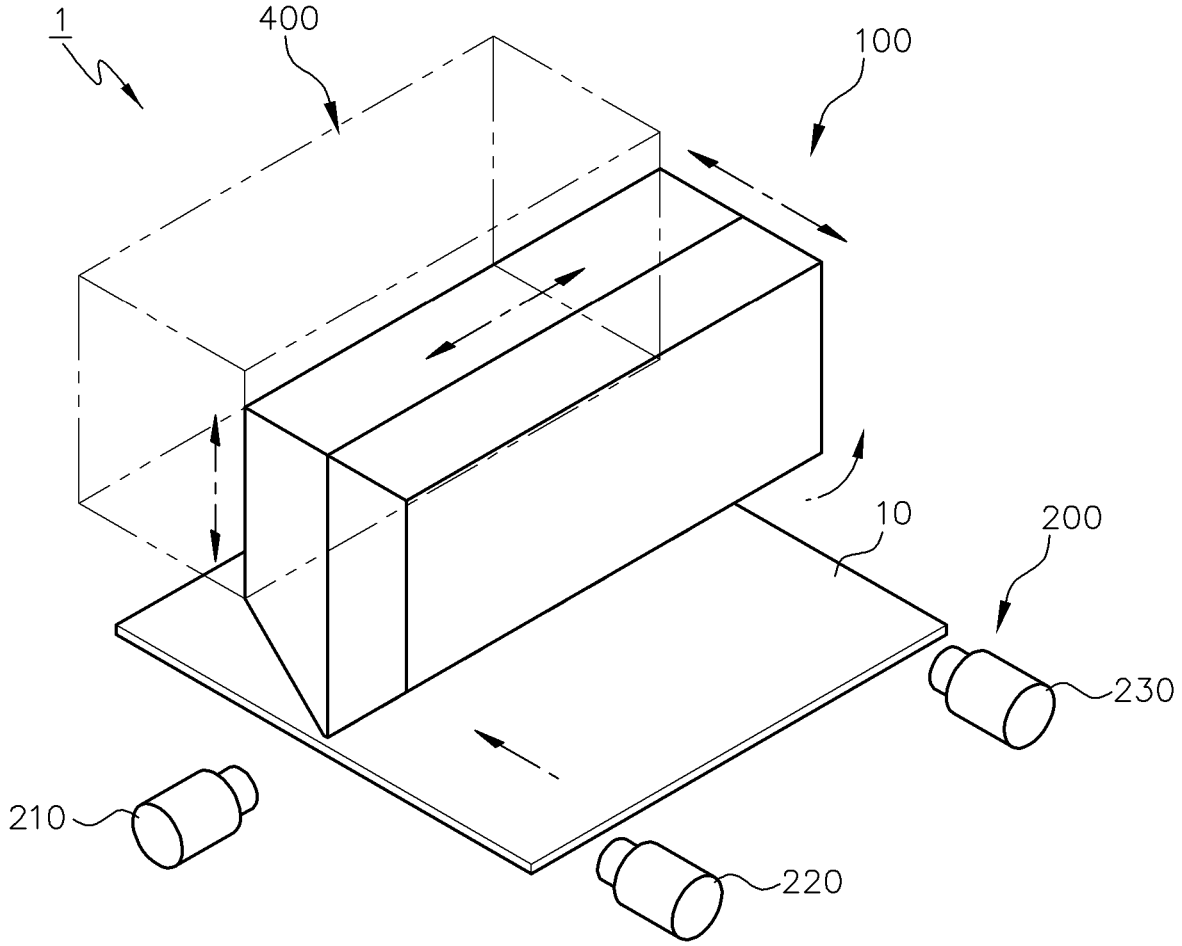
FIG. 7 is a perspective view schematically illustrating a structure in which a slot die coating apparatus according to an embodiment of the present invention includes a slot die driving unit.

FIG. 7 is a perspective view schematically illustrating a structure in which the slot die coating apparatus according to an embodiment of the present invention includes a slot die driving unit.

As described above, the control unit 300 may compare the images captured by the image capturing unit 200 during the coating process, that is, the meniscus of the ink 20 discharged from the slot die 100 (first camera 210) and the shape of coating bead between the slot die 100 and the substrate 10 (second cameras 220 and 230) with the reference image, determine a state of the slot die 100 and a state of the ink 20 applied to the substrate 10, and adjust the position of the slot die 100 so as to control the operation of the slot die 100.

As illustrated in FIG. 7, the slot die driving unit 400 may be connected to the slot die 100 and drive the slot die 100 so as to adjust the position of the slot die 100. Although not illustrated, the slot die driving unit 400 may straightly move the slot die 100 in directions of three axes, that is, an X-axis (for example, the transfer direction of the substrate 10), a Y-axis (for example, the width direction of the substrate 10), and a Z-axis (for example, the vertical direction), and may rotate or tilt the slot die 100 around a specific axis on a vertical plane or a horizontal plane. The slot die driving unit 400 may use a linear motion system so as to move the slot die driving unit 400 in the directions of the three axes, and may use a combined linear motion system as well as various types of actuators such as a driving motor or a rotating cylinder so as to rotate or tilt the slot die 100.

Meanwhile, as described above, in the case of the roll-to-roll printing apparatus that performs the coating process by using the slot die 100, a film-type substrate 10 (hereinafter, collectively referred to as a film F) may be deformed by external conditions. Thus, in order to improve the coating uniformity of the ink 20, it is necessary to determine a state of the film F, as well as the state of the slot die 100 and the state of the ink 20 applied to the film F during the coating process.

Figure 8:
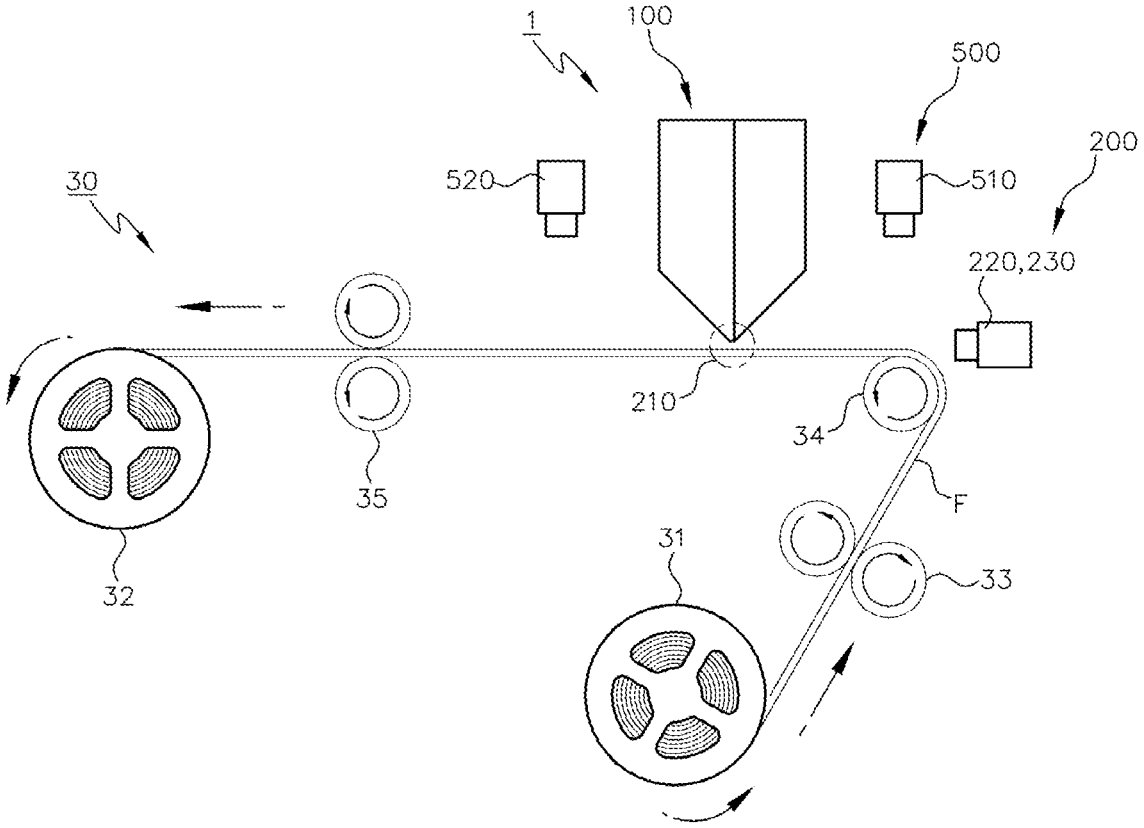
FIG. 8 is a view schematically illustrating a configuration of a roll-to-roll printing apparatus including a slot die coating apparatus according to an embodiment.

FIG. 8 is a view schematically illustrating the configuration of the roll-to-roll printing apparatus including the slot die coating apparatus according to an embodiment.

As illustrated in FIG. 8, the roll-to-roll printing apparatus may include a film transfer unit 30 for transferring the film F to the slot die coating apparatus. The film transfer unit 30 may include an unwinder 31, a rewinder 32, and a plurality of transfer rollers 33, 34, and 35.

The unwinder 31 may be disposed adjacent to the slot die coating apparatus 1 and may supply the film F to the slot die coating apparatus 1 by continuously unwinding the film F. In addition, the rewinder 32 may be disposed adjacent to the slot die coating apparatus 1 and may continuously rewind the film F supplied after the coating process has been finished in the slot die coating apparatus 1.

In addition, the plurality of transfer rollers 33, 34, and 35 may be disposed between the unwinder 31 and the slot die coating apparatus 1, between the slot die coating apparatus 1 and the rewinder 32, and the like and may guide the transfer of the film F.

Although not illustrated in detail, the control unit 300 may perform control so that the transfer speed of the film F supplied from the unwinder 31 to the slot die coating apparatus 1 and the transfer speed of the film F recovered from the slot die coating apparatus 1 to the rewinder 32 are constantly maintained. In addition, although not illustrated in detail, a tension measurement unit (not illustrated) such as a load cell may be provided between sections where the film F is transferred, that is, the unwinder 31, the slot die coating apparatus 1, the rewinder 32, and the plurality of transfer rollers 33, 34, and 35.

As illustrated in FIG. 8, in a case where the slot die coating apparatus 1 according to an embodiment of the present invention is applied to the roll-to-roll printing apparatus, the slot die coating apparatus 1 may further include a pattern capturing unit 500 that is disposed adjacent to the slot die 100 and captures at least one coating pattern provided in the film F during the coating process. The pattern capturing unit 500 may use a CMOS camera, a CCD camera, or the like.

Figure 9:
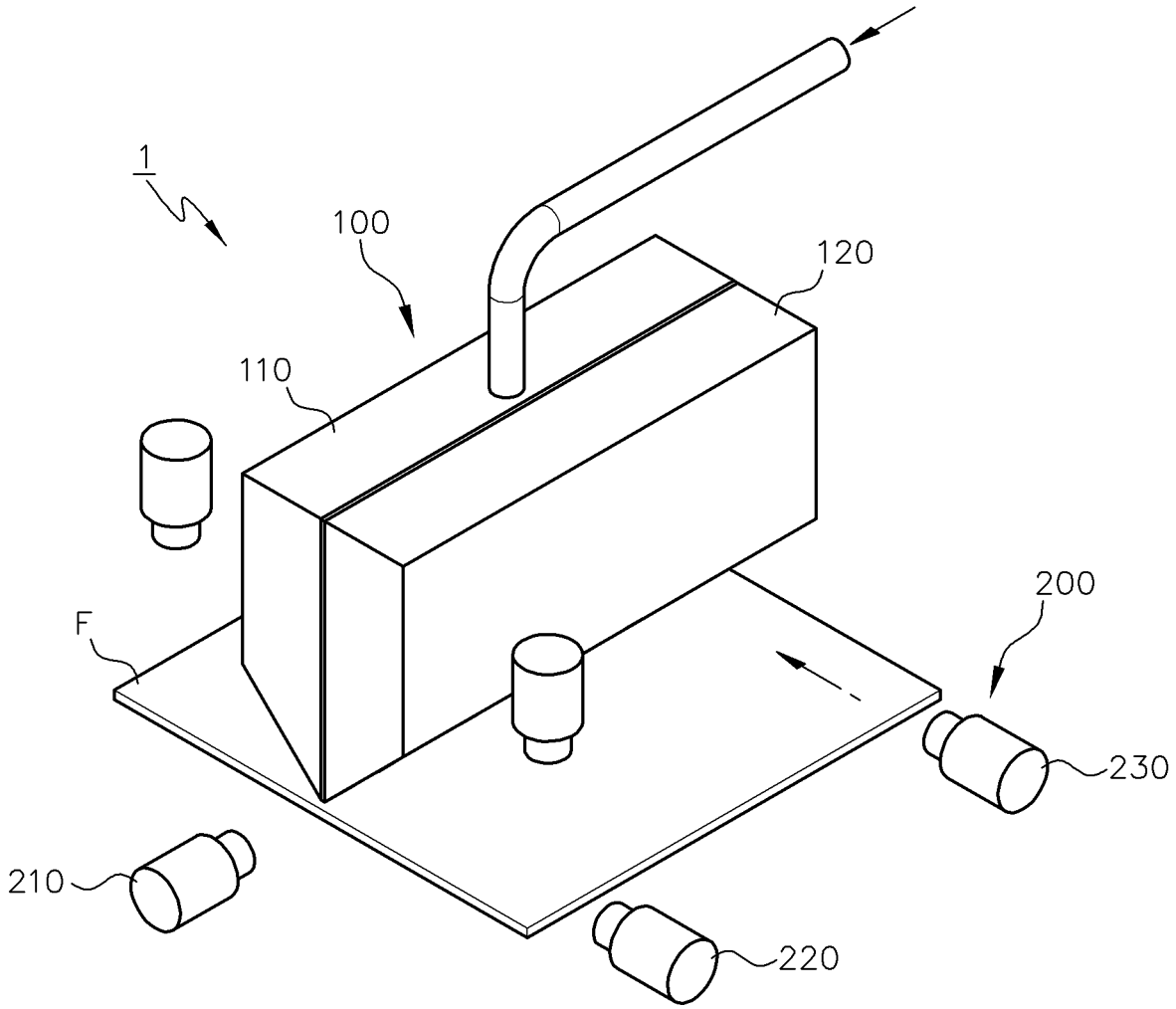
FIG. 9 is a perspective view schematically illustrating a structure in which a slot die coating apparatus according to an embodiment of the present invention includes a pattern capturing unit.
Figure 10:
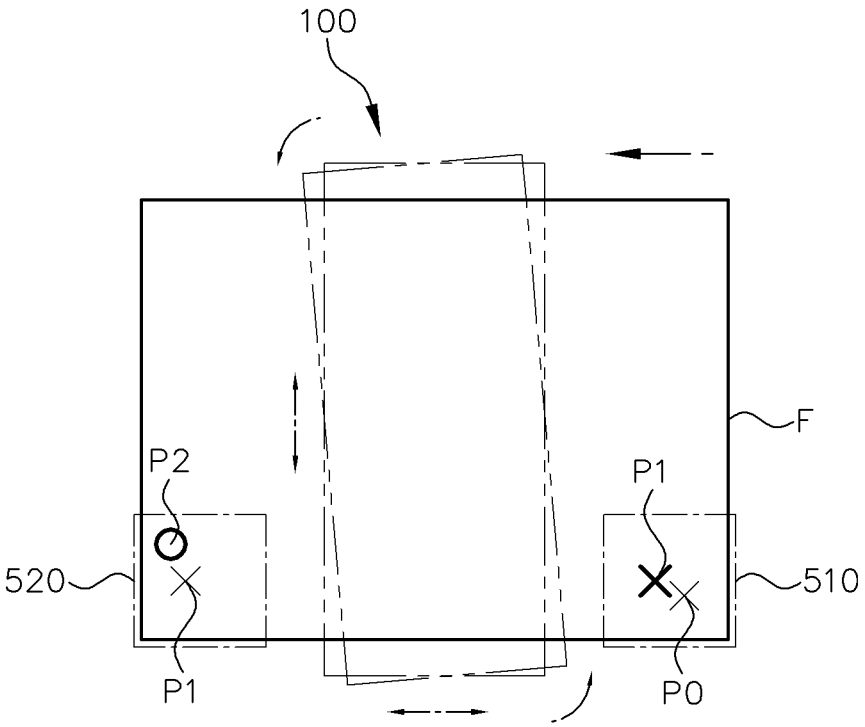
FIG. 10 is a view schematically illustrating an example in which a pattern capturing unit of a slot die coating apparatus according to an embodiment of the present invention captures a coating pattern.

FIG. 9 is a perspective view schematically illustrating a structure in which the slot die coating apparatus according to an embodiment of the present invention includes a pattern capturing unit, and FIG. 10 is a view schematically illustrating an example in which the pattern capturing unit of the slot die coating apparatus according to an embodiment of the present invention captures a coating pattern.

As illustrated in FIG. 9, the pattern capturing unit 500 may include at least one third camera 510 disposed at the front end of the slot die 100 along the transfer direction of the film F, and at least one fourth camera 520 disposed at the rear end of the slot die 100 along the transfer direction of the film F.

As illustrated in FIG. 10, the third camera 510 may capture a first coating pattern P1 provided in the film F before the coating process, and the fourth camera 520 may capture the first coating pattern P1 and a second coating pattern P2 provided in the film F after the coating process. The first coating pattern P1 means a pattern coated by a coating process before a specific coating process is performed, and the second coating pattern P2 means a pattern coated by the specific coating process. In another example, the first coating pattern P1 and the second coating pattern P2 may mean a separate mark printed in advance on the film F, regardless of the coating process.

FIGS. 9 and 10 illustrate an example in which one third camera 510 is arranged at the front end of the slot die 100 and one fourth camera 520 is arranged at the rear end of the slot die 100, but the present invention is not limited thereto. The number and the arrangement form of the third camera 510 and the fourth camera 520 may be variously modified by those skilled in the art.

As illustrated in FIG. 10, the control unit 300 may compare the first coating pattern P1 captured by the at least one third camera 510 with a first reference pattern P0, compare the first coating pattern P1 with the second coating pattern P2 captured by the at least one fourth camera 520, determine the state of the film F according to the transfer of the film F, and control the unwinder 31, the rewinder 32, and the plurality of transfer rollers 33, 34, and 35 to adjust the position of the slot die 100 or the transfer speed of the film F.

That is, in the case of the slot die coating apparatus 1 illustrated in FIGS. 8 to 10, it is possible to control the operation of the slot die 100 and the transfer of the film F by determining the state of the slot die 100 and the state of the ink 20 applied to the film F by using the meniscus of the ink 20 and the shape of coating bead between the slot die 100 and the film F, which are captured by the image capturing unit 200 including the first camera 210 and the second cameras 220 and 230, and determining the state of the film F by using the first coating pattern and the second coating pattern, which are captured by the pattern capturing unit 500 including the third camera 510 and the fourth camera 520.

As described above, in the case of the slot die coating apparatus according to an embodiment of the present invention, it is possible to monitor the state of the slot die and the state of the ink applied to the substrate in real time and thinly and uniformly apply the ink to the substrate by controlling the operation of the slot die and the transfer of the substrate by capturing the state of the slot die and the state of the ink applied to the substrate by using the image capturing unit while the coating process using the slot die is performed. In addition, since the image capturing unit is configured by the first camera that captures the meniscus of the ink discharged from the slot die and the second camera that captures the shape of coating bead between the slot die and the substrate, the state of the slot die and the state of the ink applied to the substrate can be captured and monitored in real time during the coating process. In addition, since the diffuser for diffusing the ink is provided in the discharge port of the slot die, it is possible to further improve the coating uniformity of the ink with respect to the substrate. Furthermore, since the operation of the slot die and the transfer of the substrate are controlled in real time by capturing the coating pattern provided in the substrate by using the pattern capturing unit while the coating process using the slot die is performed, it is possible to control the register with respect to the film-type substrate, thereby improving the quality of products produced through the coating process.

Meanwhile, the coating apparatus that performs the coating process on the substrate by using the slot die has been described as an example, but the present invention is not limited thereto. The present invention can be applied to various processes and technical fields as long as the apparatus performs a process on a substrate by discharging ink by using a slot die. Furthermore, the coating apparatus that performs the coating process on the film-type substrate by using the slot die in the slot die coating apparatus has been described as an example, but the present invention is not limited thereto. The present invention can be applied to various processes and technical fields as long as the apparatus performs a process on a substrate by discharging ink by using a slot die.

Meanwhile, preferred embodiments of the present invention have been described and illustrated in the drawings. Although specific terms are used herein, all such terms are intended to have the same meaning as commonly understood in order to fully convey the concept of the present invention and for better understanding of the present invention and should not be taken as limiting the scope of the present invention. It is apparent to those skilled in the art that various modifications or alterations can be made thereto without departing from the scope of the present invention.

INDUSTRIAL APPLICABILITY

The present invention is applicable to technical fields relating to a slot die coating apparatus, and more particularly, to a slot die coating apparatus which is capable of monitoring a state of a slot die and a state of ink applied to a substrate in real time and is capable of uniformly and thinly applying ink to the substrate.

The invention claimed is:

1. A slot die coating apparatus comprising:

a slot die configured to perform a coating process by applying ink to a substrate;

an image capturer disposed adjacent to the slot die and configured to capture an image in real time showing a state of the slot die and a state of the ink applied to the substrate during the coating process;

an electronic controller configured to compare the image captured by the image capturer with a reference image and control in real time an operation of the slot die, a vertical position of the slot die, and a transfer of the substrate; and a slot die driver connected to the slot die and configured to move the vertical position of the slot die by driving the slot die, wherein the image capturer comprises:

at least one first camera disposed at at least one side end of the slot die and configured to capture a meniscus of ink discharged from the slot die;

at least one second camera disposed at at least one of a front end and a rear end of the slot die relative to a transfer direction of the substrate and configured to capture a shape of coating bead and a gap between the slot die and the substrate; and an image capturing driver configured to drive the at least one second camera to reciprocate along a length direction of the slot die, wherein the electronic controller is configured to compare the meniscus of the ink captured by the at least one first camera with a first reference image, and compare the shape of the coating bead and the gap between the slot die and the substrate captured by the at least one second camera with a second reference image, and the electronic controller is configured to control the operation of the slot die, the vertical position of the slot die, and the transfer of the substrate according to a comparison result of the electronic controller by adjusting at least one of an ink flow rate, a slot die height, or a transfer speed of the substrate.

2. The slot die coating apparatus of claim 1, wherein the slot die comprises:

a first body having a length corresponding to a width of the substrate and defining a space in which the ink supplied from an outside source is accommodated;

a second body having a length corresponding to the first body and forming a discharge port, through which the ink is discharged, when coupled to the first body; and at least one diffuser disposed adjacent to the discharge port and configured to diffuse the ink discharged through the discharge port.

3. The slot die coating apparatus of claim 2, wherein the slot die further comprises a shim plate disposed between the first body and the second body and having a plurality of slits opened in a downward direction at positions adjacent to the discharge port.

4. The slot die coating apparatus of claim 1, further comprising a pattern capturer disposed adjacent to the slot die and configured to capture in real time at least one coating pattern provided in the substrate during the coating process, wherein the electronic controller is configured to compare the at least one coating pattern captured by the pattern capturer with a reference pattern and controls in real time the operation of the slot die and the transfer of the substrate.

5. The slot die coating apparatus of claim 4, wherein the pattern capturer comprises:

at least one third camera disposed at the front end of the slot die along the transfer direction of the substrate and configured to capture a first coating pattern provided in the substrate before the coating process; and at least one fourth camera disposed at the rear end of the slot die along the transfer direction of the substrate and configured to capture the first coating pattern and a second coating pattern provided in the substrate after the coating process, wherein the electronic controller is configured to compare the first coating pattern captured by the at least one third camera with a first reference image, compare the first coating pattern with the second coating pattern captured by the at least one fourth camera, and control the operation of the slot die and the transfer of the substrate.

* * * * *